United States Patent [19]

Navarro et al.

[11] Patent Number: 4,478,271

[45] Date of Patent: Oct. 23, 1984

[54] GUIDE APPARATUS FOR A RIGID STARTING BAR

[75] Inventors: Carlos R. Navarro; José M. Mallén Fuentes, both of Barcelona, Spain

[73] Assignee: Concast Service Union AG, Zürich, Switzerland

[21] Appl. No.: 355,892

[22] Filed: Mar. 8, 1982

[30] Foreign Application Priority Data

Mar. 12, 1981 [CH] Switzerland ..... 1689/81

[51] Int. Cl.³ ..... B22D 11/08

[52] U.S. Cl. ..... 164/426; 164/446

[58] Field of Search ..... 164/425, 426, 445, 446, 164/484

[56] References Cited

U.S. PATENT DOCUMENTS

| | | | |
|---|---|---|---|
| 3,344,844 | 10/1967 | Reinfeld | 164/426 |
| 3,628,595 | 10/1971 | Mitchell | 164/426 |
| 3,930,533 | 1/1976 | Rokop | 164/426 |
| 4,150,710 | 4/1979 | John | 164/426 |

FOREIGN PATENT DOCUMENTS

| | | | |
|---|---|---|---|
| 17645 | 10/1980 | European Pat. Off. | 164/425 |
| 2714338 | 10/1978 | Fed. Rep. of Germany . | |
| 45-10321 | 4/1970 | Japan | 164/426 |
| 4737816 | 9/1972 | Japan | 164/445 |
| 4804303 | 2/1973 | Japan | 164/445 |

*Primary Examiner*—Kuang Y. Lin
*Assistant Examiner*—Richard K. Seidel
*Attorney, Agent, or Firm*—Werner W. Kleeman

[57] ABSTRACT

A long rigid starting or dummy bar, after passing through a withdrawal and straightening unit, is suspended by means of an automatically operating connection device in a holder arm pivotable about the center of the curved arc or arcuate-shaped path of travel of the secondary cooling zone. The holder arm removes the starting bar out of the withdrawal and straightening unit by virtue of its own pivotal movement which is accomplished by means of a fluid-operated cylinder unit, such as a hydraulic cylinder unit, and places such starting bar in a position where it does not disturb the cast strand region of the installation. The holder or holding arm is mounted and constructed such that it can be placed by means of a crane or other appropriate facility into an almost vertical position, so that the entire space above the withdrawal and straightening unit and the subsequent rolls are freely accessible from above.

10 Claims, 2 Drawing Figures

GUIDE APPARATUS FOR A RIGID STARTING BAR

BACKGROUND OF THE INVENTION

The present invention relates to a new and improved construction of guide apparatus for a rigid starting or dummy bar.

Generally speaking, the present invention concerns a continuous casting installation for the casting of strands. This casting installation contains a flow-through continuous casting mold, a secondary cooling zone, a rigid starting or dummy bar which can be introduced through the secondary cooling zone into the continuous casting mold, and a withdrawal and straightening unit or machine containing drive or pinch rolls for driving the cast strand and/or starting bar. Additionally, there is provided a suspension device for the starting bar at a position spaced or remote from the region of the cast strand guides or roller apron, as well as a further or second transport device for the starting bar, by means of which the starting bar, after departing from the withdrawal and straightening unit, can be moved into a rest or ineffectual position.

In German patent publication No. 2,629,453 and the corresponding U.S. Pat. No. 3,930,533 granted Jan. 6, 1976, there has been disclosed to the art a continuous casting machine for casting strands which contains a long rigid starting bar which, during withdrawal by the withdrawal and straightening unit, can be moved into its rest position. The foot or tail-end of such starting or dummy bar is introduced into a free wheeling gear blocking device. With this system the entire movement of the starting bar is accomplished by the same drive or pinch rolls.

What is disadvantageous with this type of starting bar drive is that the starting bar together with the thereat connected cast strand must be conveyed into its rest or ineffectual position. On the one hand, upon reaching such rest position a terminal switch must generate a signal for interrupting the drive which, during this phase, already acts upon the cast strand which displaces the starting bar in front of such cast strand. On the other hand, the head portion or end of the cast strand, at this moment in time, is already at a relatively great distance from the horizontal tangent of the cast strand and there is required a correspondingly great amount of energy for straightening the cast strand, since the starting bar must be withdrawn far enough out of the cast strand guides or roller aprons.

This shortcoming was already eliminated by means of the casting installation disclosed in U.S. Pat. No. 3,344,844, granted Oct. 3, 1967. In that prior art system the starting bar, after departing from the drive or pinch rolls, is pulled by means of a traction cable into its rest position, and the disconnection of the starting bar is accomplished at a site near to the horizontal tangent The drawback of this state-of-the-art construction, as well as also a further drawback of the installation disclosed in the aforementioned German patent publication No. 2,629,453 and the corresponding U.S. Pat. No. 3,930,533 as well as appertaining to further known installations, such as disclosed for instance in the German patent publication No. 2,714,338 and U.S. Pat. No. 3,628,595, granted Dec. 21, 1971, resides in the fact that the diverse guide and drive devices for the starting bar are arranged in an immobile manner above the cast strand guides or roller apron, so that it is difficult or, in fact, impossible to have access to the cast strand guides from above by means of a crane or the like, something of appreciable importance during repair and maintenance work.

SUMMARY OF THE INVENTION

Therefore, with the foregoing in mind it is a primary object of the present invention to provide a new and improved construction of a guide apparatus for a rigid starting or dummy bar which is not associated with the aforementioned drawbacks and limitations of the prior art proposals.

Another and more specific object of the present invention aims at the provision of a new and improved construction of continuous casting installation wherein the roller aprons for the cast strand are conveniently accessible from above by means of a crane or other appropriate facility or hoisting device.

Yet a further significant object of the present invention concerns a new and improved construction of guide apparatus for a rigid starting or dummy bar, which is relatively simple in design, extremely economical to manufacture, highly reliable in operation, not readily subject to breakdown or malfunction, and requires a minimum of maintenance and servicing.

Now in order to implement these and still further objects of the invention, which will become more readily apparent as the description proceeds, the continuous casting installation of the present development is manifested by the features that the further or second transport device comprises a holder or holding arm pivotably driven by a force-applying or power source. This holder arm or arm member is provided with a connection device for the releasable connection of the foot or tail-end of the starting bar with the holder arm. This holder arm member can be selectively brought into a rest position retaining the starting bar at a remote or spaced location from the strand guide or roller apron for the cast strand, into a coupling position serving for connecting and disconnecting, as the case may be, the starting bar from the connection device, and a maintenance position which affords access to the strand guide or roller apron.

In accordance with one construction of the invention the connection device comprises a snap-action connection mechanism rendering possible an automatic locking or engagement of the foot or tail-end of the starting or dummy bar.

Furthermore, the connection device can be constructed in such a manner that the snap-action connection mechanism, sometimes also simply referred to as the snap mechanism, possesses a plate spring or set of plate springs which can be loaded during withdrawal of the starting bar. The force of such plate spring or set of plate springs is greater than the weight of the starting or dummy bar, however smaller than the sum of such weight and the traction force of the withdrawal and straightening unit or machine.

The holder arm is advantageously constructed such that when assuming its maintenance position it is disposed almost vertically or upright, in the coupling position extends essentially horizontally and in the rest or ineffectual position is disposed in an intermediate position between both of these two afore-mentioned positions.

Moreover, the holder arm is advantageously structured as a maintenance catwalk or equivalent structure.

The force-applying or power source for pivoting or rocking the holder arm beneficially comprises a fluid-operated, particularly a hydraulic cylinder unit

BRIEF DESCRIPTION OF THE DRAWINGS

The invention will be better understood and objects other than those set forth above, will become apparent when consideration is given to the follwing detailed description thereof. Such description makes reference to the annexed drawings wherein.

DETAILED DESCRIPTION OF THE PREFERRED EMBODIMENTS

Figure 1:
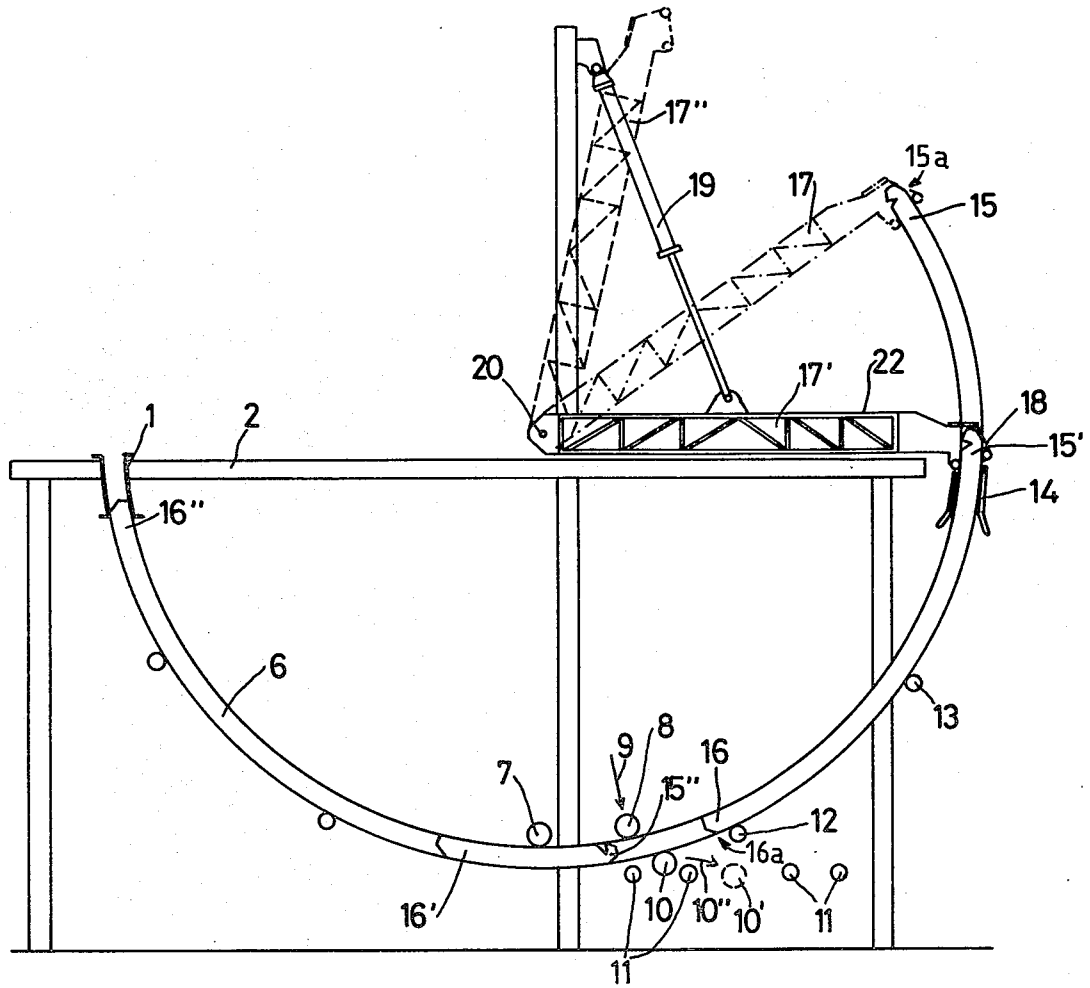
FIG. 1 schematically illustrates in side view a continuous casting installation for casting strands and constructed according to the invention.

Describing now the drawings, it is to be understood that only enough of the construction of the continuous casting installation has been depicted in the drawings, particularly in the showing of FIG. 1, as will readily enable those skilled in the art to understand the underlying principles and concepts of the present development. Thus, in FIG. 1 there have only been shown those components or parts of the continuous casting installation for casting strands and which are necessary for comprehending the development of the present invention. It will be seen that a flow-through or open-ended continuous casting mold 1, for the casting of strands, is arranged upon a casting platform 2. Arranged after the continuous casting mold 1, viewed in the casting direction, is a secondary cooling zone 6, whose conventional roller apron and spray devices have not been particularly illustrated in order to simplify the illustration. In conventional manner there is arranged at the end of the one-quarter circular path of the secondary cooling zone 6 a withdrawal and straightening unit or machine 7, 8 which contains a drive or pinch roll 7 and a bending roll 8. The drive roll 7 is applied with a defined force to the continuously cast strand, this force being adequate in order to transmit to the cast strand or casting the driving force of such drive roll 7. The bending roll 8 is likewise applied against the cast strand, and specifically, with a force which is adequate for linearly bending the curved or arc-shaped cast strand. For the last-mentioned bending purpose this bending roll 8 is mounted in a manner such that under the action of its force it can follow the strand which gives as it is being bent straight, whereby such bending roll 8 can be displaced in the direction of the arrow 9. A short distance after the bending roll 8 there is arranged at the opposite side of the cast strand a support roll 10 which can be pivoted from the illustrated position, along the arrow 10″, into the position 10′ where such support roll then forms part of a substantially horizontally extending roller apron composed of the rolls 11.

The previously illustrated and discussed components serve both for guiding the hot cast strand as well as the starting or dummy bar (with the exception of the rolls 11). The parts of the installation which now will be described serve exclusively for guiding and supporting the starting or dummy bar 15, 16. This dummy bar 15, 16—which has been schematically illustrated by its head-end 16 and its tail or foot-end 15—and which bears upon the rolls 12 and 13 is structured as a rigid starting bar. This rigid starting bar 15, 16 possesses a curvilinear or arcuate-shaped configuration which enables displacing such starting bar along an arcuate-shaped path, the radius of which coincides with the radius of curvature of the starting bar 15, 16, this radius of curvature being equal to the radius of curvature of the secondary cooling zone 6.

The starting or dummy bar 15, 16 is releasably connected at its tail or foot-end 15 with a holder or holding arm 22 and by pivoting this holder arm 22 into the position 17, this starting or dummy bar 15, 16 can be correspondingly displaced. Pivoting of the holder arm 22, which is structured as a repair and maintenance catwalk structure, can be accomplished by means of a fluid-operated force-applying or power device, here shown as a hydraulic cylinder unit 19, so that the holder arm 22 can be pivoted about the pivot axis or point 20.

Having now had the benefit of the foregoing description of the continuous casting installation its mode of operation will be described and is as follows:

Prior to the start of the casting operation the starting or dummy bar 15, 16 is located in its rest or ineffectual position, wherein the mold plug or head-end 16 assumes the position 16*a*, whereas the foot or tail-end 15 assumes the position 15*a* and the holder or holding arm member 22 assumes the position 17 shown in chain-dot lines in FIG. 1. By accomplishing a controlled depressurizing of the hydraulic cylinder unit 19 the holder arm or arm member 22 is lowered into the essentially horizontal position 17′, wherein the bar tail-end 15 arrives at the position 15′ and the bar head-end 16 arrives at the position 16′. In this position of the starting bar 15, 16 the mold plug or head-end 16 already has been introduced into the withdrawal and straightening rolls 7 and 8 and the therewith operatively correlated conventional and therefore here not particularly illustrated counter-rolls, so that the further movement of the starting bar 15, 16 can be accomplished by such rolls 7 and 8.Under the action of the driving force of the drive roll 7 the bar foot or tail-end 15 initially is detached from the connection device 18 which is operatively connected with the holder arm 22 and then such starting bar 15, 16 is further conveyed to such an extent until the bar head-end 16 arrives at the position 16″ where it closes or plugs from below the continuous casting mold 1. The length of the starting bar 15, 16 must be dimensioned such that in this position 16″ the bar foot or tail-end 15, at the position 15″, still is in engagement with the drive roll 7 and its counter-roll. Then at the start of the casting operation or pour, by reversing the direction of rotation of the drive roll 7, it is possible to retract the starting or dummy bar 15, 16 out of the continuous casting mold 1, and it then entrains in conventional manner the hot continuously cast strand or casting. Shortly prior to the time that the mold plug or head-end 16 of the starting bar 15, 16 enters the withdrawal and straightening unit, the foot or tail-end 15 of the starting bar 15, 16 assumes the position 15′ while guided by the guide elements 14, for instance formed as sheet metal members, whereby the tail-end 15 of the starting bar 15, 16 is automatically engaged in the connection device 18. The further retraction movement is now augmented by the upward pivoting of the holder arm 22 into the position 17, and then solely accomplished completely by the holder arm 22 after the barhead-end 16 has departed from the effective region of the drive roll or drive roll means 7.

When the cut-off or disconnect location between the starting bar 15, 16 and the cast strand reaches a position between the rolls 8 and 10, then the cast strand is pressed downwardly, under the action of the pressure of the bending roll 8, against the first one of the rolls 11 and thus straightened, while the plug or head-end 16 of the starting bar 15, 16 is supported by the roll 10. In conventional manner the head-end 16 of the starting bar 15, 16 is formed in such a way that it is fixedly connected with the cast strand when subjected to traction or tension forces, but however can be easily disconnected or detached therefrom by shearing forces. The thus straightened cast strand now extends horizontally against the roll 10, which is only supported against the action of vertically arising forces, and thus pivots this roll 10 into the position 10' where it forms part of the horizontal roller apron or strand guide arrangement composed of the rolls 11. The starting bar 15, 16 is then pulled further without any interruption until the holder arm 22 has reached the position 17. The bar head-end 16 then remains in the position 16*a*, supported by the roll 12, where it no longer disturbs the movement of the hot cast strand or casting.

When it is necessary to perform maintenance or repair work at the roller apron or at the withdrawal and straightening unit or at some other location at such region, it is of appreciable advantage to be able to render accessible the space or region above the working zone for the purpose of introducing a not particularly illustrated crane or equivalent facility or device. For this purpose, the holder arm 22 is constructed and mounted in a manner such that, following the time that the starting bar 15, 16 has been brought into the position 15", 16", it can be upwardly pivoted into the holder arm position 17", where following disconnection of the hydraulic cylinder unit 19, it can be upwardly pulled by means of the aforementioned crane or the like and secured in any appropriate manner in this extreme raised position. Securing of the holder arm 22 in the raised position 17" can be accomplished by any suitable securing mechanism, such as a snap-action mechanism or the like. After securing of the arm the crane can be detached from the holder arm 22 and employed for performing the maintenance or repair work. At the end of such work the holder arm 22 is then again lowered into its horizontal position 17' by reversing the sequence of working steps previously described.

The starting or dummy bar 15, 16 remains in its position 15", 16" until there is accomplished the next pour.

Figure 2:
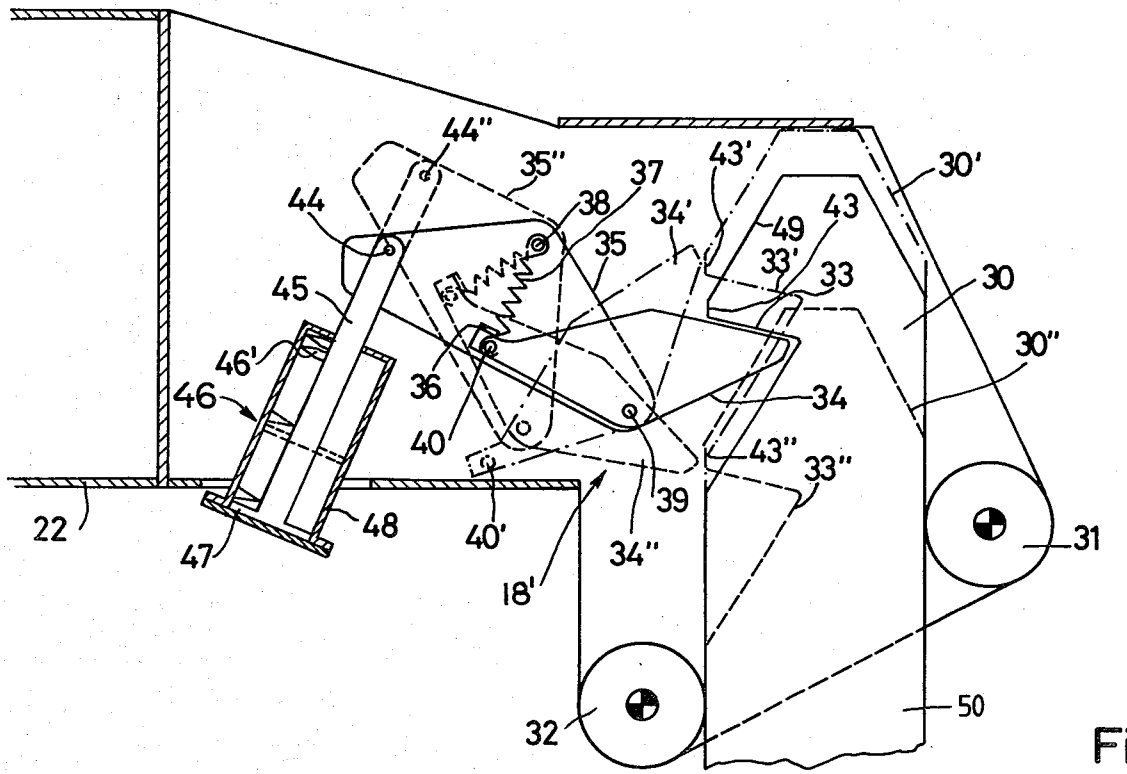
FIG. 2 is an enlarged view showing details of the connection or attachment device between the holder arm and the starting or dummy bar.

FIG. 2 illustrates in detail a possible construction of the connection device 18 of the arrangement of FIG. 1, which serves to connect the bar foot or tail-end, here designated by reference character 30, of the starting bar 50 automatically and by snap-action with the holder or holding arm 22.

The tail or foot-end 30 of the starting bar 50, which has been introduced between the rolls 31 and 32, possesses a notched impact or stop surface 33 as well as a nose member 43. The connection device 18 comprises a snap-action connection mechanism 18' which consists of a pivotal or tilt lever 34 which is mounted upon a pivot lever 35, a resilient element, such as the spiral spring 37 which retains the tilt lever 34 and the pivot lever 35 in a certain predetermined relative position, and a plate spring means 46 or equivalent structure comprising a set of plate springs 46' which strives to maintain the pivot or pivotal lever 35 under the application of a large amount of force in one of its two extreme or terminal positions.

In the rest or ineffectual position of the connection device 18, which can be assumed both with the starting bar 50 latched or engaged as well as also with the starting bar removed, all of the parts are located in the position shown with full lines. Starting from the engaged position of the bar foot or tail-end 30 such is pulled downwardly and therefore presses against the tilt lever 34 which is rotated in clockwise direction until assuming the broken line illustrated position 34". The tilt or pivot lever 34 which is rotatably mounted by means of a bearing pin 39 upon the pivot lever 35, however cannot rotate in the clockwise direction towards the pivot lever 35, since it bears against a stop or impact member 36 of the pivot lever 35. Consequently, during the downward movement of the bar tail or foot-end 30 the tilt lever 34 and the pivot lever 35 together with the bearing or pivot pin 38, at which there is rotatably mounted the pivot lever 35, are rocked or pivoted into the positions 34" and 35", respectively. By means of a bearing of pivot pin 44 there is articulated at the pivot lever 35 an armature or rod 45 of plate spring means 46, which pre-biases the pivot lever 35 into its rest position. The plate spring means 46 comprises a housing 48 and the plate spring or the set of plate springs 46' which are contained therein and biased by means of flange 47 attached at the armature or rod 45. During a downward movement of the bar foot or tail-portion 30 it is necessary to overcome the force of the plate spring 46' by means of the levers or lever members 34 and 35. In accordance with one exemplary embodiment of the equipment the starting bar possesses a weight of 2000 kg, the force of the drive rolls in the withdrawal and straightening unit amounts to about 4000 kg, and the force of the plate spring means 46 therefore amounts to somewhat less than 6000 kg, in order to render possible a faultless withdrawal of the starting or dummy bar, since the withdrawal force is constituted by the sum of the weight of the suspended starting bar and the traction force of the withdrawal and straightening unit.

When the nose member 43" of the tail or foot-end 30" moves past the edge of the tilt lever 34 which is at position 34", the entire connection device 18 snaps back into its rest position. It is advantageous to capture the thus released energy in that, for instance, there is arranged in the housing 48 a not particularly illustrated counterspring or equivalent structure.

Since the path of the pivot pin 44 as it moves from its rest position into the position 44" is not linear, rather extends along a circle or curvilinear path having its center at the pin member 38, the pivot or mounting pin 44 either must be guided in an elongate hole at the pivot lever 35 or the plate spring housing 48 must be attached pivotably at the holder arm 22.

Upon introduction of the bar tail or foot-end 30 into the connection device 18, under the action of its inclined or camming surface 49 the tilt lever 34 is pivoted about the non-movable pivot point 39 in the counter clockwise direction into the position 34', and the spiral spring 37 is tensioned, this spring being tensioned between the pin member 38 and a pin member 40 which is only connected with the tilt lever 34. The bar tail or foot-end 30 is introduced to such an extent, i.e. into position 30' that the tilt lever 34, after sliding upon the nose member 43', again can snap back into its rest position where it secures the bar foot-end 30 against any undesired downward movement.

The described snap-action connection mechanism functions automatically with respect to the engagement or latching of the bar foot-end and can be also automatically released upon exceeding a pre- determined tension force threshold.

While there are shown and described present preferred embodiments of the invention, it is to be distinctly understood that the invention is not limited thereto, but may be otherwise variously embodied and paracticed within the scope of the following claims.

Accordingly, what we claim is:

1. A continuous casting installation comprising:

a continuous casting mold;

means defining an arc-shaped secondary cooling zone operatively associated with said continuous casting mold and through which a correspondingly arc-shaped rigid starting bar having a tail-end and a head can be introduced from the secondary cooling zone with its head leading into the continuous casting mold and withdrawn therefrom in the reverse direction;

a withdrawal and straightening unit equipped with at least one drive roll for selectively driving at least any one of a cast strand, the starting bar or both;

guide means for the cast strand;

said at least one drive roll of said withdrawal and straightening unit defining a first transport device for the starting bar;

a second transport device acting upon the region of said tail-end of said starting bar in order to augment the action of the withdrawal and straightening unit during retraction of the starting bar and, when necessary, to assume such withdrawal of the starting bar and to return the starting bar into the withdrawal and straightening unit in a reverse direction;

said second transport device serving for moving the starting bar into a rest position after departure from the withdrawal and straightening unit;

said second transport device comprising a spatially fixedly positioned but pivotable holder arm;

a force-applying source for pivotably driving said holder arm;

a connection device provided for said holder arm for the releasable connection of said tail-end of the starting bar with the holder arm in said region of said tail-end of the staring bar; and said holder arm being structured to be selectively pivotable into any one of (i) a rest position retaining said head of said starting bar in a predetermined spaced relationship from said first transport device, (ii) into a coupling position serving for selectively coupling and decoupling said starting bar in said region of said tail-end thereof and the connection device while the head of the starting bar is located on a remote side of said first transportion device, and (iii) into a maintenance position providing access to the guide means for the cast strand.

2. The continuous casting installation as defined in claim 1, wherein:

said connection device is structured to define a snap-action connection mechanism rendering possible automatic and relatively rapid locking engagement of the tail-end of the starting bar.

3. The continuous casting installation as defined in claim 2, wherein:

said snap-action connection mechanism comprises plate spring means effective against a withdrawal movement of the tail-end of the starting bar.

4. The continuous casting installation as defined in claim 3, wherein:

said plate spring means are structured such that they possess a force which is less by a safety factor than the sum of the weight of the starting bar and the traction forces exerted by the drive roll.

5. The continuous casting installation as defined in claim 1, wherein:

said coupling position of the holder arm, in which said starting bar in said region of said tail-end thereof is coupled to or decoupled from said connection device and said head of the starting bar is located on said side of the first transport device situated closer to said continuous casting mold, corresponds to a substantially horizontal position, the maintenance position of the holder arm corresponds to an approximately vertical position, and the rest position, in which said starting bar in said region of said tail-end thereof is coupled to said connection device and said head of the starting bar is in said predetermined spaced relationship from said first transport device, corresponds to a position intermediate both of the aforesaid horizontal and vertical positions.

6. The continuous casting installation as defined in claim 1, wherein:

said holder arm is structured as a repair and maintenance catwalk structure.

7. The continuous casting installation as defined in claim 1, wherein:

said force-applying source comprises hydraulic cylinder means.

8. The continuous casting installation as defined in claim 1, further including:

a casting platform substantially extending through a center of curvature defined by said arc-shaped secondary cooling zone; and said holder arm having a first end pivotably linked to said casting platform at said center of curvature and a second end at which said connection device is provided.

9. A continuous casting installation comprising:

a continuous casting mold;

means providing a secondary cooling zone operatively associated with said continuous casting mold and through which a rigid starting bar having a tail-end and a head can be introduced from the secondary cooling zone with its head leading into the continuous casting mold and withdrawn therefrom in reverse direction;

a withdrawal and straightening unit for selectively driving at least any one of the cast strand, the starting bar or both;

a transport device solely acting upon the region of said tail-end of the starting bar in order to augment the action of the withdrawal and straightening unit during retraction of the starting bar and, when necessary, to assume such withdrawal of the starting bar;

said transport device serving for moving the starting bar into a rest position after departure from the withdrawal and straightening unit and for returning the starting bar in a reverse direction into the withdrawal and straightening unit;

said transport device including starting bar-engagement means;

a force-applying source for driving said starting bar-engagement means;

said starting bar-engagement means being provided with a connection device for the releasable connection of the starting bar in said region of said tail-end thereof; and said transport device being structured to be pivotable selectively into any one of (i) a rest position retaining the head of the starting bar in a predetermined spaced relationship from said withdrawal and straightening unit (ii) into a coupling position serving for the selective coupling and decoupling of the tail-end of the starting bar in said region of said tail-end thereof to and from the connection device and placing the head of the starting bar on a side of the withdrawal and straightening unit situated closer to said continuous casting mold, and (iii) into a maintenance position providing access to predetermined parts of the casting installation.

10. A continuous casting installation comprising:

a continuous casting mold;

means defining an arc-shaped secondary cooling zone operatively associated with said continuous casting mold and through which a correspondingly arc-shaped rigid starting bar having a tail-end and a head can be introduced from the secondary cooling zone with its head leading into the continuous casting mold in a first direction and withdrawn therefrom in a reverse direction;

a withdrawal and straightening unit equipped with at least one drive roll for selectively driving and straightening a cast strand or for driving the starting bar in said first direction as well as in said reverse direction;

said at least one drive roll of said withdrawal and straightening unit defining a first transport device for the starting bar;

a second transport device serving for moving the starting bar into a rest position after departure from the withdrawal and straightening unit in which said head of the starting bar is located at a predetermined spaced relationship from said first transport device;

said second transport device comprising a holder arm;

said holder arm having opposed ends and being suspended at one of its ends substantially at a center of curvature of said arc-shaped secondary cooling zone;

a force-applying source for pivotably driving said holder arm about said center of curvature;

said holder arm being equipped at its other end with a connection device for the releasable connection of said starting bar predominantly in the region of said tail-end thereof with the holder arm; and said holder arm being structured to be pivotable selectively into any one of (i) a rest position retaining the tail-end of the starting bar in connection with said connection device and the head of the starting bar in said predetermined spaced relationship from said first transport device, (ii) a substantially horizontal coupling position serving for selectively coupling and decoupling the starting bar predominantly in said region of said tail-end thereof and the connection device and for placing the head of the starting bar on a side of the first transport device which is situated closer to said continuous casting mold, and (iii) an approximately vertical maintenance position providing access to the guide means for the cast strand.

* * * * *

UNITED STATES PATENT AND TRADEMARK OFFICE

CERTIFICATE OF CORRECTION

PATENT NO. : 4,478,271

DATED : October 23, 1984

INVENTOR(S) : Navarro et al

It is certified that error appears in the above-identified patent and that said Letters Patent is hereby corrected as shown below:

Column 3, line 8, after "the" please delete "follwing" and insert --following--

Column 7, line 53, after "first" please delete "transportion" and insert --transport--

Signed and Sealed this

*Eighteenth* Day of *June 1985*

[SEAL]

*Attest:*

DONALD J. QUIGG

*Attesting Officer*

*Acting Commissioner of Patents and Trademarks*